United States Patent [19]

Clark et al.

[11] 4,186,876

[45] Feb. 5, 1980

[54] SYSTEM POWERED DAMPER BLADE ASSEMBLY FOR USE IN AN AIR CONDITIONING SYSTEM

[75] Inventors: William E. Clark, Syracuse; Carl C. Herb, Camillus; Reginald S. Greene, Rochester, all of N.Y.

[73] Assignee: Carrier Corporation, Syracuse, N.Y.

[21] Appl. No.: 858,140

[22] Filed: Dec. 7, 1977

[51] Int. Cl.[2] ..... F24F 7/00

[52] U.S. Cl. ..... 236/49; 137/468; 137/497

[58] Field of Search ..... 236/49, 80 R; 137/468, 137/497

[56] References Cited

U.S. PATENT DOCUMENTS

| | | | |
|---|---|---|---|
| 1,630,755 | 5/1927 | Milker | 236/80 R |
| 3,143,292 | 8/1964 | Church et al. | 236/49 |
| 3,554,112 | 1/1971 | Herb | 98/40 |
| 3,719,321 | 3/1973 | McNabney | 236/49 |
| 3,806,027 | 4/1974 | Ginn et al. | 236/49 |
| 3,817,452 | 6/1974 | Dean | 236/49 |
| 3,840,177 | 10/1974 | Osheroff | 236/49 |
| 3,845,783 | 11/1974 | De Lepeleire | 236/49 X |
| 3,945,565 | 3/1976 | Lynch et al. | 236/49 |
| 4,017,025 | 4/1977 | Dravnieks et al. | 236/49 |
| 4,040,564 | 8/1977 | Waeldner et al. | 236/49 |

FOREIGN PATENT DOCUMENTS

| | | | |
|---|---|---|---|
| 594213 | 10/1935 | Fed. Rep. of Germany | 236/80 R |

*Primary Examiner*—Lawrence J. Staab

*Attorney, Agent, or Firm*—J. Raymond Curtin; Barry E. Deutsch

[57] ABSTRACT

An air conditioning system having conditioned air supplied through at least one duct includes a damper blade assembly for varying the volume of conditioned air flow through said duct. A first inflatable bellows is connected to the damper blade assembly to vary the position thereof in said duct. The bellows is inflated in response to changes in the supply pressure of the conditioned air to maintain a substantially constant volume conditioned air flow downstream of said damper blade assembly. A second inflatable bellows is connected to the damper blade assembly for further varying the position thereof in the duct. The second inflatable bellows is inflated in response to the temperature of the air in the enclosure whereby the quantity of air discharged thereinto is reduced as the temperature of the enclosure approaches a predetermined level.

2 Claims, 1 Drawing Figure

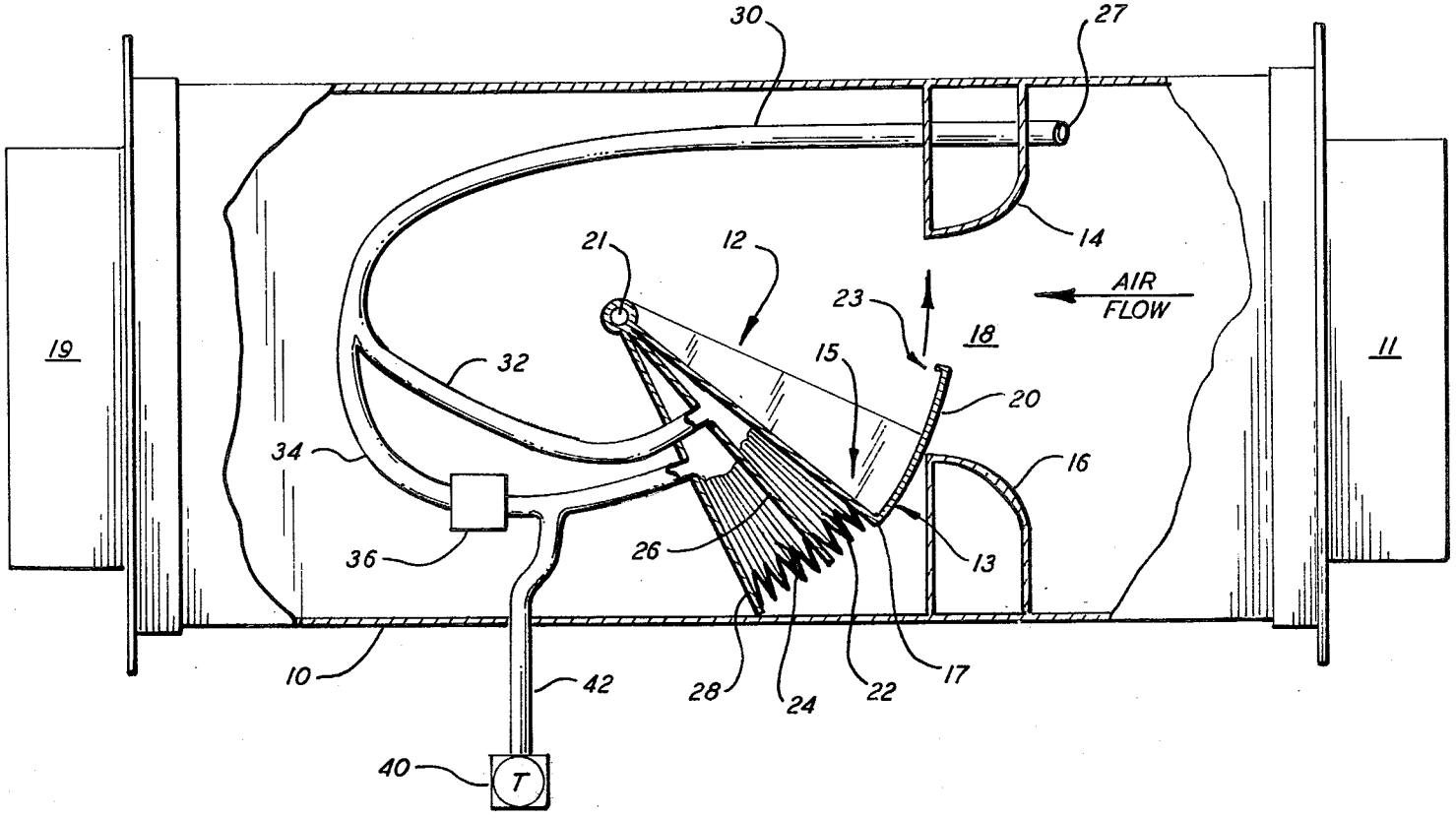
11
19
AIR FLOW
27
14
16
18
20
13
17
22
23
15
24
30
12
28
26
21
42
32
T
40
36
34
10

SYSTEM POWERED DAMPER BLADE ASSEMBLY FOR USE IN AN AIR CONDITIONING SYSTEM

BACKGROUND OF THE INVENTION

This invention relates to an air conditioning system including a damper blade assembly rotatably mounted within a duct provided to deliver conditioned air to an enclosure, and in particular, to an arrangement for controlling the position of the damper blade assembly within the duct in accordance with the sensed supply air pressure and temperature of the air in the enclosure.

Many multiroom structures, such as office buildings and schools, constructed during the past several years, include air conditioning systems to deliver either relatively warm or cool conditioned air from a central source thereof to each of the enclosures or rooms in the building. Typically, one or more ducts are employed to deliver the air to each enclosure. Very often, a damper blade assembly or similar mechanism is installed in the duct to regulate the flow of air to one or more diffusers or discharge outlets located in the enclosure being conditioned by the discharge of air thereinto. The movement of the damper blade assembly may be responsive to changes in the conditioned air supply pressure and/or changes in the temperature of the enclosure.

In some air conditioning systems of the prior art, as represented by U.S. Pat. Nos. 3,143,292 and 3,554,112, the diffusers or discharge outlets located in the enclosure being conditioned have included an inflatable bellows to regulate the flow of conditioned air into the enclosure. Inflation of the bellows has been controlled through a device responsive to the pressure of the supply air to maintain a substantially constant volume flow of conditioned air into the enclosure. In addition, in some of the systems, a temperature responsive device has been combined with the pressure responsive device to reduce the flow of conditioned air as the temperature in the enclosure approaches a desired predetermined level. The pressure responsive device delivers a pressure signal to the bellows which is proportional to but less than supply air pressure. As the temperature of the air in the enclosure approaches a predetermined set point, the temperature responsive device will function to increase the magnitude of the signal to the bellows to increase the inflation thereof. When it is desired to eliminate all flow of conditioned air, the pressure signal to the bellows will essentially approach the supply air pressure.

In other air conditioning systems, it has been found desirable to regulate the flow of air through the duct by providing a damper blade assembly within the duct upstream of the discharge outlets or diffusers. A bellows is inflated in direct response to changes in the supply air pressure to maintain a substantially constant volume flow of conditioned air. Typically, unlike the arrangements disclosed in the above-cited patents, the bellows pressure is approximately identical to the supply air pressure. Thus, if it is desired to decrease the air flow as the temperature in an enclosure approaches a predetermined level or set point, an additional force must be generated to move the damper blade assembly.

U.S. Pat. Nos. 3,806,027 and 3,945,565 illustrate various arrangements heretofore available to regulate the flow of conditioned air through a duct by modulating the position of a damper blade assembly mounted within the duct. However, none of the prior art patents heretofore cited illustrate the arrangement of the present invention which has been found to be extremely effective in regulating the flow of air through a duct to a plurality of discharge outlets whereby the flow of air is maintained substantially constant irrespective of any changes in the conditioned air supply pressure. The present invention includes temperature responsive means to reduce the flow of air below the predetermined level as the temperature in an enclosure approaches a predetermined set point.

SUMMARY OF THE INVENTION

It is accordingly an object of this invention to regulate the flow of conditioned air through a supply duct to a discharge outlet located in an enclosure.

It is a further object of this invention to regulate the flow of conditioned air to maintain a constant flow irrespective of changes in the pressure of the supply air.

It is a further object of this invention to regulate the flow of conditioned air through a supply duct whereby the flow of conditioned air is reduced below a predetermined constant volume level as the temperature in an enclosure approaches a predetermined set point.

It is a further object of this invention to provide effective and efficient control means to regulate the position of a damper blade mounted within a duct to control the conditioned air flow through said duct.

These and other objects of the present invention are attained in an air conditioning system having conditioned air supplied through at least one duct. The system includes a damper blade assembly to vary the volume of conditioned air flow through the duct. A first inflatable bellows is connected to the damper blade assembly to vary the position thereof in the duct. Inflation of the bellows is varied in response to changes in the supply pressure of the conditioned air to maintain a substantially constant volume conditioned air flow downstream of the damper blade assembly. A second inflatable bellows is connected to the damper blade assembly to further vary the position thereof in the duct. Inflation of the second bellows is varied in response to changes in temperature of the air in the enclosure whereby the quantity of air discharged thereinto is reduced as the temperature level of the enclosure approaches a predetermined set point.

BRIEF DESCRIPTION OF THE DRAWING

The single FIGURE of the drawing illustrates a sectional, somewhat schematic, view of a conditioned air supply duct having a damper blade assembly mounted therein with the control of the present invention.

DESCRIPTION OF THE PREFERRED EMBODIMENT

Referring now to the drawing, there is disclosed a preferred embodiment of the present invention. The invention relates to a control for regulating the position of a damper blade assembly of the type used to control the flow of air through a duct employed to deliver conditioned air from a central source thereof to at least one outlet or diffuser located in a room.

Duct 11 is employed to deliver conditioned air from a central source thereof (not shown) to an enclosure or room in a multiroom building such as an office or school. The conditioned air flows through the duct to one or more discharge outlets or diffusers located in various enclosures in the building.

A rotatable damper assembly 12 is positioned within a casing or housing 10 connected between inlet duct 11 and outlet duct 19. The damper assembly is rotatably mounted on a shaft 21 extending transverse to the direction of air flow through duct 11. Shaft 21 is located at the approximate vertical center of the opening 18. Damper blade assembly 12 includes a damper 13 comprising an L-shaped member 15 having a relatively long leg 17 and a relatively short leg 20. The curved face of plate 20 confronts the flow of air through a flow opening 18 defined between a pair of spaced cutoff plates or seal members 14, 16. Cutoff plates 14, 16 are mounted within the duct to define therebetween the flow opening 18 for the conditioned air flowing from the upstream duct 11 to the downstream duct 19. The damper blade assembly is designed to regulate the flow of air through the flow opening. Damper 13 may be rotated in response to the pressure of the air upstream thereof and in response to the temperature of the air in the enclosure as shall be more fully explained hereinafter.

Damper blade assembly 12 further includes a pair of inflatable bladders 22 and 24. Bladder 22 is sandwiched between the opposed surfaces of plates 17 and 26. Plate 26 rotates about shaft center 21. Second inflatable bladder 24 is attached to the other surface of plate 26 and the opposed surface of a fourth plate 28. Plate 28 is fixed in a permanent position within casing 10. Inflation of either of the inflatable bellows 22, 24 will cause damper blade 13 to rotate in a counterclockwise direction as indicated by arrow 23.

A tube or conduit or similar device 30 has an open end 27 disposed in the air flow path upstream of air flow opening 18. Tube 30 has a pair of branches eminating therefrom, with a first branch 32 connected to first inflatable bellows 22 and the second branch 34 connected to second inflatable bellows 24. Thus, each of the bellows is inflated by the delivery of conditioned air thereto through the connecting tubes 30, 32, or 34.

A restrictor or similar flow control device 36 is placed within the flow path defined by tube 34. A bleed type thermostat 40 of the type well known to those skilled in the art is connected via line 42 to line 34 upstream of inflatable bellows 24. Essentially, thermostat 40 is provided to sense the temperature of the air in one of the enclosures served by the air conditioning system. Thermostat 40 will regulate the magnitude of the pressure signal furnished to bellows 24 by selectively communicating conduits 34, 42 with the atmosphere. A bleed type thermostat is disclosed in U.S. Pat. No. 3,595,475 assigned to the same assignee as the assignee hereof.

OPERATION

Typically, there are several outlets or diffusers attached to casing 10, with the air conditioning system including several additional supply air ducts, with each duct having its own diffuser(s). Accordingly, the conditioned air supply pressure upstream of the damper blade assembly will vary depending upon the actual number of discharge outlets that are in use at any one time. Thus, if it is desired to maintain a constant flow of conditioned air to the various outlets irrespective of changes in the conditioned air supply pressure, the damper blade assembly must be modulated or positioned so as to regulate the flow of air through flow opening 18 in accordance with the actual changes in the supply air pressure.

As noted previously, conduit 30 communicates the air duct at a point upstream of cutoff plates 14, 16 with first inflatable bellows 22. Thus, conditioned air at supply pressure is delivered to the first inflatable bellows. The degree of inflation of bellows 22 will vary directly with changes in the supply pressure. As the supply air pressure increases, inflation of bellows 22 will likewise increase to rotate damper 13 toward cutoff plate 14. Conversely, if the supply air pressure should decrease, the pressure in bellows 22 will correspondingly decrease with the damper thus rotating toward cutoff plate 16 through a system of springs and levers (not shown) as more fully described in copending Application Ser. No. 858,141, Filed Dec. 7, 1977, in the names of William Clark and Carl Herb. Thus, a relatively constant flow of conditioned air is maintained through flow opening 18 irrespective of changes in the supply air pressure.

To permit a greater degree of control whereby the flow of air can be reduced below the predetermined constant volume level, conduit 34 communicates conduit 30 with second inflatable bellows 24. As noted previously, bleed type thermostat 40 is located upstream of inflatable bellows 24 in communication with conduit 34. Thermostat 40 is responsive to the temperature of the air in an enclosure served by duct 19. As the temperature of the air in the enclosure approaches a predetermined level or set point, the bleed type thermostat will prevent flow of air through conduit 42 to increase the degree of inflation of second bellows 24. This, in turn, will cause damper 13 to rotate upwardly toward cutoff plate 14 to reduce the flow of conditioned air through flow opening 18. Conversely, as the temperature of the air in the enclosure rises above the predetermined set point, the bleed type thermostat will open, thereby bleeding air from conduit 34 through conduit 42, to reduce inflation of bellows 24. Damper 13 will rotate in a clockwise direction to increase the flow through opening 18. However, in no case will the flow of air increase above the predetermined maximum constant volume level. Restrictor 36 is provided in conduit 34 to permit the inflation and deflation of second bellows 24 in response to thermostat 40.

The predetermined constant volume flow of air is set by positioning the damper blade assembly within the fluid flow opening at an initial location. Thus, for a given flow, as for example 1000 cfm, and for a given pressure, as for example 1" w.g., the damper blade assembly will have a specific location within opening 18. The predetermined location for the damper blade assembly is regulated by rotating plate 26. Thus, if a larger quantity of constant volume air is desired, plate 26 of the damper blade assembly will be moved in a clockwise direction. A greater quantity of conditioned air will thence flow through the fluid flow opening 18 to the downstream end of the duct. If it is desired to obtain a relatively smaller constant volume flow of air, plate 26 of the damper blade assembly is rotated in a counterclockwise direction. The position of the damper blade assembly within the fluid flow opening 18 as determined by the angular position of plate 26 relative to the cutoff plates will determine the constant volume flow of air at a predetermined pressure. Any variations in the actual supply air pressure will result in damper 13 rotating in the manner heretofore described to maintain the constant volume flow. Further, as the temperature in the enclosure approaches a predetermined set point, the damper blade will be rotated in a counterclockwise direction due to inflation of bellows 24 to thereby reduce the flow of air below the constant volume level.

The damper blade assembly in accordance with the present invention is highly effective and efficient in regulating the flow of air to a plurality of discharge outlets or diffusers in response to changes in supply air pressure and changes in the temperature of the enclosure.

While a preferred embodiment of the present invention has been described and illustrated, the invention should not be limited thereto but may be otherwise embodied within the scope of the following claims.

We claim:

1. An air conditioning system including a conditioned air supply duct for delivering conditioned air to an enclosure comprising:

a damper assembly for modulating the flow of conditioned air including a housing positioned within the air flow path through said duct and having a damper blade pivotally mounted therewithin;

at least one cutoff plate mounted in said housing with said damper blade and cutoff plate defining therebetween a flow path for said conditioned air;

a first plate pivotally mounted within said housing about the same center of rotation as said damper blade and being spaced therefrom for defining a first space;

a second plate mounted within said housing in a predetermined position spaced from said first plate for defining a second space, said first plate being located between said damper blade and said second plate;

a first inflatable bellows disposed within a selected one of said spaces, the degree of inflation of said bellows varying directly with the pressure of said conditioned air in said housing upstream of said damper assembly, said damper blade moving relative to said second plate in response to inflation of said bellows to maintain a substantially constant flow of air to said enclosure irrespective of changes in said conditioned air supply pressure; and temperature override means including second inflatable bellows disposed within the other of said spaces and connected to said damper blade to move said blade relative to said second plate, the degree of inflation of said second bellows varying inversely with the difference between sensed air temperature of said enclosure and a predetermined set point temperature, with the damper blade being moved thereby to reduce the flow of air below said substantially constant level as the temperature of the air in said enclosure approaches said predetermined set point.

2. An air conditioning system in accordance with claim 1 wherein said first inflatable bellows is disposed within said first space and said second inflatable bellows is disposed within said second space, the angular position of said first plate and said first bellows within said housing for a predetermined conditioned air supply pressure determining the magnitude of said constant volume of conditioned air flow.

* * * * *